United States Patent [19]

Rondone

[11] Patent Number: 4,817,905

[45] Date of Patent: Apr. 4, 1989

[54] FOLDABLE STAND-UP SUPPORT DEVICE

[75] Inventor: Sam J. Rondone, La Mirada, Calif.

[73] Assignee: House of Packaging, Inc., City of Industry, Calif.

[21] Appl. No.: 37,317

[22] Filed: Apr. 13, 1987

[51] Int. Cl.[4] ..... A47B 97/04

[52] U.S. Cl. ..... 248/459; 40/120; 248/174; 248/460; D19/20

[58] Field of Search ..... 248/459, 460, 463, 174; 40/152.1, 120, 124.1, 539; D19/20

[56] References Cited

U.S. PATENT DOCUMENTS

| | | | |
|---|---|---|---|
| 2,097,553 | 11/1937 | Gruenberg | 248/174 X |
| 2,643,811 | 6/1953 | Bolding . | |
| 2,855,708 | 10/1958 | Nichols | 40/124.1 X |
| 2,902,785 | 9/1959 | Nichols | 40/120 |
| 2,978,824 | 4/1961 | Paschal | 248/459 X |
| 3,204,851 | 9/1965 | Rouder et al. . | |
| 3,275,280 | 9/1966 | Nichols | 40/120 X |
| 3,275,281 | 9/1966 | Sampson | 248/459 |
| 3,941,302 | 3/1976 | Tyrseck . | |
| 4,428,555 | 1/1984 | Atkins | 248/459 |

FOREIGN PATENT DOCUMENTS 2410638 4/1975 Fed. Rep. of Germany .

*Primary Examiner*—Ramon S. Britts
*Assistant Examiner*—David L. Talbott
*Attorney, Agent, or Firm*—Townsend & Townsend

[57] ABSTRACT

A display device includes a planar display panel, having a display side and an art side, supported at an angle by an angled leg secured to the aft side by a hinge having first and second portions. The first portion is resilient and is secured to the leg near, but spaced apart from, the free end of the leg. The second portion has a first part, secured to the aft side, and a second part, between the first part and the hinge axis, free of the aft side. The leg is movable between a folded position, in which the leg is adjacent the aft side and the free end of the leg is between the hinge and the aft side, and a use position, more than 90° away from the folded position, in which the leg lies at an angle to the aft side with the free end out from between the aft side and the hinge. In the use position, the first hinge portion is flexed and tends to bias the second hinge portion towards the aft side while the hinge itself tends to straighten out, thus biasing the free end towards the aft side. When the two forces balance, a stable use position is achieved.

4 Claims, 2 Drawing Sheets

FOLDABLE STAND-UP SUPPORT DEVICE

FIELD OF THE INVENTION

The present invention relates generally to support devices for display and packaging purposes and more particularly to a simple, foldable cardboard package which is stable in both a flat storage position and in an easel-like stand-up position.

BACKGROUND OF THE INVENTION

Merchandisers throughout the world have endeavored to display and package their products in a simple and effective manner. In the class of stand-up displays which also may serve as packages for merchandise, there is, for example, German Patent No. 24 10 638 which discloses a generally rectangular box with a cover which encloses and protects products inside the box during storage or shipment. The cover can be folded rearwardly over the top to provide access to the contents of the box. When folded rearwardly through a sufficient arc, the cover and the box form an A-frame-like structure which supports the open box in an upright position. A shortcoming of the package is that it is unstable in its upstanding position because the folded cover is not restrained to the box.

As for supports for display only, artists have long used the well-known easel to support their paintings. Display packages utilizing the artist's easel concept are also known in the art. There is, for example, a display package made from a panel of stiff cardboard with a product-holding receptacle to which a flat cardboard flap is joined. Perforations in the flap enable it to be pivoted into an inclined position relative to the receptacle to form an A-frame-like structure.

A tab foldable from the back of the receptacle can be mechanically attached to the folded flap to render the package stable in its A-frame configuration. The tab is difficult to manipulate and use because it must be folded out and extended through tight slits in the relatively stiff cardboard of flap. Improper handling can bend or tear the tab and thereby render it useless for forming a stable connection between the receptacle and the tab. Moreover, repeated insertions of the tab into the slits will degrade the slits and they will lose their holding effect. Furthermore, if the packagage and its support flap are squashed down, the tab and indentation mechanism may be destroyed.

SUMMARY OF THE INVENTION

The present invention is a stand-up support device for uses such as a product holding package, which is stable in upright and flat storage configurations. The device is simply constructed and easily transformed from the flat storage to the upright position and vice-versa by a simple pivoting about a hinge of a support leg of the device. The package, constructed of a resilient sheet material such as cardboard, applies a spring force to the leg which biases the support leg into one or the other of its two operative positions.

Broadly speaking, the present invention is directed to a foldable device for alternatively positioning a support surface for a product, a container, a blister package or the like, in a generally upright position and a generally flat storage position. The device, hereinafter referred to as "package", has a flat display panel and a support leg attached to the panel and hingeably movable relative thereto about a hinge axis between the storage position, in which the leg is adjacent and substantially parallel to the display panel, and a use position, in which the support leg is angularly inclined relative to the display panel. The hinge axis is defined by a score line in a resilient cardboard panel which in turn is attached to the back side of the display panel so that the hinge axis can be moved between a first position proximate to the display panel and a second position in which the axis is spaced away from the display panel. The support leg further includes an extension which protrudes over and past the hinge axis and which engages and slides along the back side of the display panel when the leg is pivoted about the hinge axis. This in turn moves the hinge axis relative to the display panel and thereby generates a spring force which biases the support leg into its first or second positions.

In the flat storage position, the display panel and the support leg are essentially parallel and the extension on the support leg is located between the display panel and a support brace. This configuration provides stability in the flat, folded position.

The package is transformed from its flat storage configuration to its generally upright display or use position by simply pivoting the support leg about the hinge axis to thereby give the package an A-frame like shape. During this movement of the support leg the extension thereon slides along the backside of the display panel. This resiliently deflects the panel section, or both the panel section and the display panel, and initially increases the distance between the hinge axis and the display panel. A maximum deflection of the panel section, and the greatest distance between the hinge axis and the display panel occurs when the support leg is at an angle of 90° to the display panel. The resilient deflection of the panel section, or of both the panel section and the display panel, generates a spring force which is greatest at this point and which urges the support leg extension towards the display panel. Thereafter, pivotal movement of the support leg in either direction will decrease the deflection of the panel section, the distance between the hinge axis and the display panel, and the spring force.

As the support leg is pivotally moved from its flat storage position to and past the 90° mark, the spring force causes further movement of the leg towards its stand-up position. The same occurs when the support leg is pivotally moved in the opposite direction from its display towards its storage position: at or slightly past the 90° mark the spring force urges the support leg into its storage position.

Pivotal movement of the support leg under the spring force ceases when the friction between the edge of the leg extension sliding along the backside of the display panel, and the internal resistance against pivotal movements of the scored cardboard at the hinge axis equals the spring force. As a consequence, the spring force will not move the support leg through an arc of 180° from its flat storage position. Instead, the balanced spring force and friction forces will stably retain the support leg in an inclined position in which it defines an A-frame-like structure with the display panel.

In contrast to the prior art, the package of the present invention can be transformed into its stand-up position by simply grasping the display panel and the support leg and pivoting them relative to each other through slightly more than 90°. The package will then automatically take on its stand-up position. The package retains this configuration without the need for mechanically connecting the display panel to the support leg.

Further, and unlike prior art structures which are stable in their stand-up configuration, an accidental squashing of the package by subjecting it to a downwardly acting force from above, e.g., against the apex of the A-frame, does not occur. If such force is applied it will pivot the display panel and the support leg from their stand-up position towards and ultimately past the 90° mark, thereby allowing the package to snap back into its flat storage configuration. This is possible because there is no mechanical connection between the display panel and the support leg to retain the two in their A-frame like configuration, as was the case in the past.

In spite of the sophisticated nature of the package and the manner in which it automatically positions itself in one or the other of its two operative positions, it is exceedingly simple to use, requiring no more than the grasping of the package with both hands and pivoting the two halves of the package about a scored hinge line. The package of the present invention is equally simple to construct; it can be made from a single sheet of material, e.g., cardboard which is appropriately scored while flat, thereafter it is bent and the resulting sheet sections are fastened to each other with adhesive, staples or the like.

A further understanding of the nature and advantages of the present invention may be realized by reference to the remaining portions of this application and the attached drawings.

DETAILED DESCRIPTION OF THE PREFERRED EMBODIMENT

Figure 1:
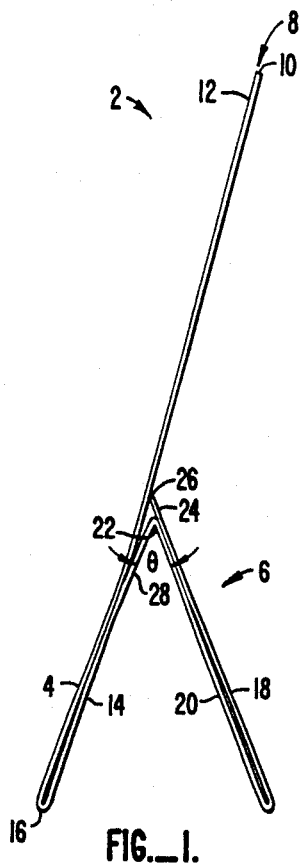
FIG. 1 is a side view of the present invention in a stand-up display position.
Figure 2:
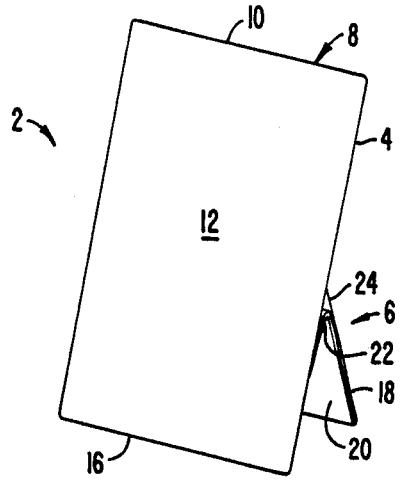
FIG. 2 is a perspective view of the support device in a stand-up display position.

Referring to FIGS. 1–5 in a first, relatively simple embodiment of the present invention, a display device 2, preferably constructed from a moderately stiff and resiliently deformable material such as cardboard, for example, broadly comprises a display panel 4 and a support brace 6 for the panel which is hingeably attached thereto. The device is stored or shipped while in its flat configuration (illustrated in FIG. 3) and it can be erected into a generally A-frame like structure (shown in FIGS. 1 and 2) which has an apex 8 in the vicinity of an upper edge 10 of the inclined display panel. In the illustrated embodiment the display panel defines a flat display surface 12 which may display, for example, printed information, pictures, prices, instruction or the like. Alternatively, or in addition thereto, objects, for display, sale use etc., can be secured or mounted to the display surface as, for example, with staples, bands, adhesive or the like (not shown).

Display panel 4 has a flat, typically rectangular shape and is integrally formed with an aft plate 14 of similar shape which extends from a lower edge 16 of the display panel along and in face-to-face contact with an aft side thereof generally upwards towards upper edge 10. Brace 6 is also integrally constructed with the aft plate, and thereby with the display panel. It is formed by two doubled-over sheets which are in face-to-face contact and define a connector plate 20 and a leg 18 which supports the display panel in its inclined position when the display device of the present invention is in its erected configuration.

A hinge 22 is formed, preferably by a score line in the cardboard sheet where the aft plate and the connector plate meet. The score line is generally parallel to lower display panel edge 16. The hinge permits pivotal movements of support brace 6 relative to the display panel 4 between a first position in which the brace is substantially parallel to the panel (illustrated in FIG. 3) and a second position in which the brace is angularly inclined by an angle $\theta$. The end of leg 18 proximate hinge 22 includes an extension 24 which projects past the hinge so that a free end 26 of the leg extension rests against the aft side of display panel 4.

Aft plate 14 is secured to display panel 4 with an adhesive or with staples, for example, so that the two are in face-to-face contact. It should be noted, however, that a flex section 28 of the aft panel adjoining hinge 22 is not attached to the display panel so that it can resiliently move towards and away relative to the display panel if a corresponding force is applied to it. The length of the flex section from the hinge axis is somewhat greater than the length of leg extension 24 for reasons more fully discussed below, Similarly, connector plate 20 is in face-to face-contact with and secured to support leg 18 of brace 6 with an adhesive, staples or the like.

Figure 5:
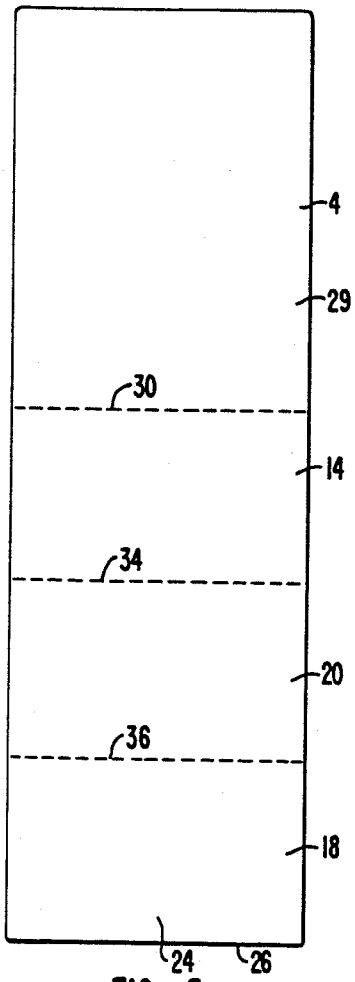
FIG. 5 is a top plan view of a blank from which the simplest embodiment of the support device may be constructed.

The display device 2 is constructed from a single, flat sheet 29 of material, say relatively flexible cardboard. It has an overall rectangular shape as is illustrated in FIG. 5. While it is in its flat configuration, a first score line 30 is formed or cut into the sheet at a position which coincides with the location of the lower display panel edge 16. A second, parallel score line 34 is formed in sheet 29 at the point which coincides with the desired location for hinge 22. A third score line 34 is formed in sheet 29 at a position which coincides with the location where leg 18 and connector plate 20 of brace 6 meet.

After sheet 29 has been scored the sheet is doubled over about score lines 30 and 36 and the aft plate 14 is secured; e.g., bonded to the aft side of display panel 4 while the connector plate 20 is bonded to support leg 18. Further, the leg extension 24 is tucked into the space between the aft side of display panel 4 and flex section 28 so that the extension extends generally parallel to the display panel from hinge 22 towards lower display panel edge 16. This is possible because flex section 28 of the aft panel can be resiliently deflected, generally away from the display panel.

Figure 3:
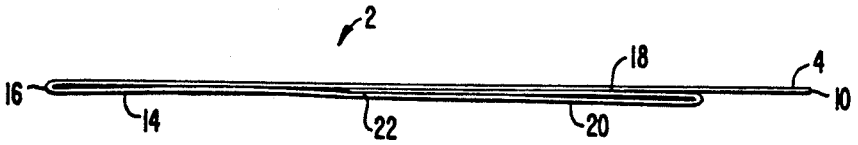
FIG. 3 is a side view of the support device in a flat storage position.
Figure 4:
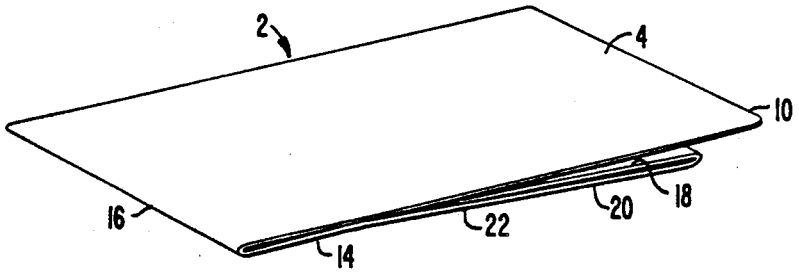
FIG. 4 is a perspective view of the support device in a flat storage position.

To erect the display device, the user grasps the display panel 4 with one hand and the support brace 6 with the other. He then pivots the two relative to each other about hinge 22 to change the shape of the device from flat as shown in FIGS. 3 and 4, to the generally A-frame like structure illustrated in FIGS. 1 and 2. As the brace is pivoted about the hinge leg extension 24 pushes against the aft side of display panel 4. This urges hinge 22 away from the display panel by resiliently deflecting the display panel 4, the flex section 28, or both, The greatest distance between hinge 22 and the display panel is reached when the leg extension 24 is perpendicular to the display panel. The continued pivotal movement of brace 6 about hinge 22 thereafter decreases the distance between the hinge and the display panel and the two move towards each other by virtue of the resiliency of both the panel 4 and the flex section 28.

During the above described relative pivotal motion of brace 6, the free end 26 of leg extension 24 slides along the aft side of the display panel. As the leg extension 24 increasingly urges the hinge axis 22 away from the display panel a spring force is generated by the panel and/or the flex section 28. When the leg extension is perpendicular to the display panel the spring force reaches a maximum. After the leg is pivotally moved past the perpendicular position the spring force generated by the display panel and flex section acts on the leg extension 24 and causes a continuation of the pivotal movement, in one or the other direction, until there is a force balance. This is attained when the spring force generated by the display panel and/or the flex section equals the interior friction of hinge 22 and the friction generated between free leg end 26 and the aft side of the display panel. When a force equilibrium is achieved, which can occur in either the flat or the erected configuration of the display device, it is in a stable position.

For the pivoting mechanism to work, it can be seen that the length of the extension 24 beyond hinge 22 and the distance of the free leg end 26 from the securing section of aft plate 14 to display panel 4 is critical. Display panel 4 and aft plate 14 must not flex so much so as to cause a permanent deformation, and extension 24 must not degrade from too great a force on it from display panel 4. Thus, the relative distances must be proper. What is proper will depend on the material utilized in construction. In one embodiment for stiff cardboard, it is found that if extension 24 is approximately one-third of the distance from the securing section to hinge 22, the folding and support mechanism function smoothly and do not degrade the construction material.

The display device of the present invention is readily collapsed back into its flat storage position. To do so, the user simply grasps the lower portion of the display panel 4 and of support brace 6 and pivots the two about hinge 22 in a counterclockwise direction (as shown in FIG. 1) until the support leg 18 has moved slightly past the perpendicular position relative to the panel. The user can continue to pivotally move the panel and the brace into their flat position. However, even if he releases the two at this point, the spring force generated by the panel and/or the flex section will cause a continued pivotal movement of the brace about the hinge 22 until the above discussed force equilibrium is reached at which point the panel and the brace are substantially parallel (as illustrated in FIGS. 3 and 4).

In its erect configuration the display device will position the display panel 4 in an upwardly-slanted orientation. Should a downwardly acting force intentionally or accidentally be applied to apex 8 of the erected display device, support brace 6 will pivot relative to the display panel in a counterclockwise direction, as viewed in FIG. 1, until support leg 18 is perpendicular to the display device. The continued application of the downwardly acting force will move the support leg past its perpendicular position whereupon the spring force generated by the panel and/or the flex section, as well as the downwardly acting force, causes a flattening of the device into its storage position (shown in FIGS. 3 and 4) without any damage to it. It can be quickly re-erected by grasping the display panel and the support brace and pivoting them into their relatively inclined positions as described above.

Figure 7:
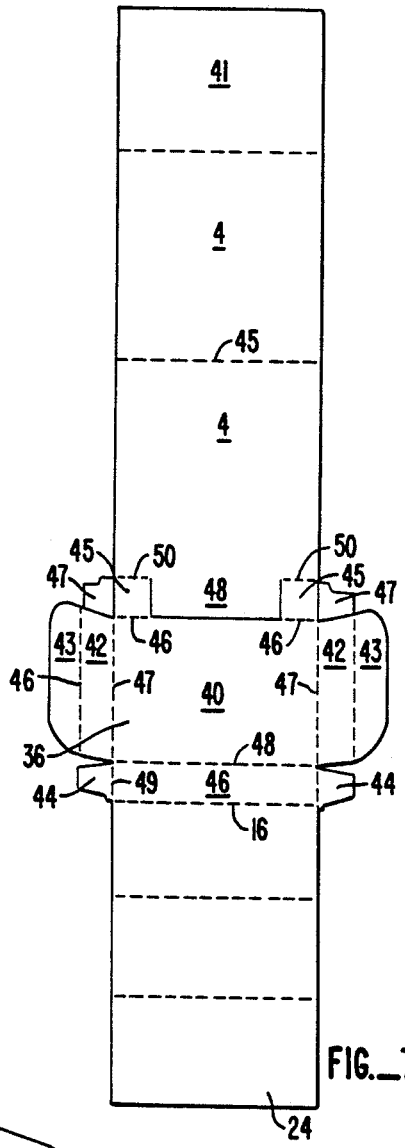
FIG. 7 is a top view of support device with an integrally attached box shown in a flat storage configuration.
Figure 6:
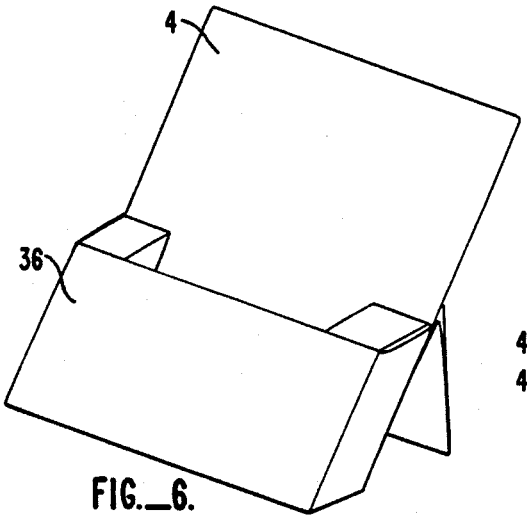
FIG. 6 is a perspective view of the support device with an integrally attached box shown in a stand-up position.
Figure 8:
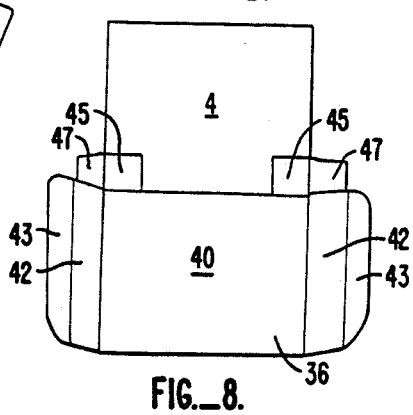
FIG. 8 is a top plan view of a blank for another embodiment of the support device with an integrally constructed box for holding a product.

Referring now to FIGS. 6–8, in another embodiment of the present invention, the display device is constructed essentially the same as the display device illustrated in FIGS. 1–5. It differs therefrom, however, in that a box-like container 36 with an aperture at the top is attached to display panel 4. This is but one embodiment of the present invention and there may be many variations of the box type as, for instance, different shapes with different numbers of apertures in the box and/or different aperture designs. For example, there could be a number of circular apertures for the display of tubes of merchandise. Regardless of the design of the box, relatively simple folding operations will produce a simply constructed yet elegant package for storage and display.

FIG. 7 is a top plan view of a blank of the present invention with box 36 forming an integral part of the invention together with the display and support parts, all of which may be formed from one sheet of material. The parts from score line 16 to extension 24 are essentially the same as that depicted in FIG. 5. The box comprises a box front 40 and a box back 41 with box sides 42. Connected to box sides 42, foldable about score lines 46 are side flaps 43 which, when the box is deployed tuck in behind box back 41 and aft plate 14. The box has a box bottom 46 which is formed by folding about score line 48. Bottom flaps 44, foldable about score lines 49, fit inside box sides 42. In this embodiment, the top of the box has an aperture 48 so that articles may protrude from the body of the box so as to be visible for display. Aperture 48 is bounded by top tabs 45 which are foldable about score lines 46 so that if box front 40 is pushed up (towards the top of FIG. 5). aperture 48 will be formed and top tabs 45 will form the sides of aperture 48. Top tabs 45 are formed from display panel 4 by bending about score lines 50. Connected to top tabs 45 are top flaps 47 bendable about score lines 49. Top flaps 47 fold back and fit inside box sides 42 when the box is deployed. Box back 41 is folded back about score line 45 and around behind the entire sheet to form the back of the box and the back 4' of display panel 4. Display panel 4 in this embodiment extends downwards behind box front 40 a small distance (generally equal to the aperture 48 extent for simplicity of construction) and is attached to box back 21 by glue or some other suitable means.

The whole box-display-support system can be converted to a flat configuration for easy storage, which is sown in FIG. 8. When box front 40 is pushed downwards in the direction of the bottom of FIG. 8, top tabs 45 lie flat on display panel 4. Box bottom 46 (not seen in FIG. 8) and side flaps 43 (not seen in FIG. 8) lie underneath box front 40 and lie flat on aft plate 14 (also not seen in FIG. 8). With box sides 42, top tabs 47, and side flaps 43 all folded out, the entire box-display-support lies flat in a configuration conducive for easy and spaceefficient storage. Thus, together with the simple support mechanism, it is possible to combine storage, display, and support functions in a single package which, when not in use, or when shipped, takes up minimal space and is convertible to storage, display, and support functions quickly and easily.

While the above description provides a full and complete description of the preferred embodiments of the present invention, various modifications, alternate constructions and equivalents may be employed. Therefore, the above description and illustrations should not be construed as limiting the scope of the invention which is defined by the following claims.

I claim:

1. A support device for supporting an object constructed from a single sheet of material defining a substantially flat first section, means for holding the object to a front side of the first section, a substantially flat second section contiguous with the first section, being generally parallel thereto, positioned on a backside of the first section, and terminating at a hinge disposed intermediate to the ends of the first section and defined by a score line in the sheet, securing means proximate to and spaced from the hinge, extending generally parallel to the hinge and securing the second section to the backside of the first section, a support leg extending from the hinge in a direction away from the second section, the leg being defined by back-to-back doubled-over third and fourth sections, the third section being contiguous with the hinge, the fourth section being secured to the third section and including an extension which extends past the hinge and which is formed so that in a first position where the leg is substantially parallel to the first section the extension is disposed between the first and second sections and between the hinge and the securing means, and so that in a second position where the leg is angularly inclined relative to the first section, a free edge of the extension abuts the backside of the first section and the leg stably positions the first section in a generally upright position with the hinge axis spaced apart from the first section.

2. A display device comprising:

a display element having a display side and an aft side;

a leg having a free end and a support end;

a hinge structure including a first and second portions joined at a hinge;

the second hinge portion secured to the leg at a region of attachment near but spaced apart from the free end to create a leg extension between the free end and the region of attachment;

the first hinge portion being a resilient structure having first and second parts the first part being secured to the aft side of the display element allowing the second part to be resiliently deflected away from the aft side, the second part being longer than the leg extension; and the leg movable between a folded position, in which the leg lies generally adjacent the aft side with the leg extension between the second part and the aft side, and a use position, in which the leg lies at an angle to the aft side with the free end out from between the aft side and the second part and the free end abuts the aft side and the hinge axis is spaced apart from the aft side, the hinge structure biasing the free end towards the aft side when in the use position, the biasing forces of the hinge and the first hinge portion balancing to maintain the leg in the use position.

3. The display device of claim 2 wherein the first part is an integral extension of the display element.

4. The display device of claim 2 wherein the display element includes a flat display side and the display element, hinge structure and leg are a unitary structure, the hinge being defined by a score line.

* * * * *